US005703599A

United States Patent [19]

Quan et al.

[11] Patent Number: 5,703,599

[45] Date of Patent: Dec. 30, 1997

[54] INJECTION MOLDED OFFSET SLABLINE RF FEEDTHROUGH FOR ACTIVE ARRAY APERTURE INTERCONNECT

[75] Inventors: Clifton Quan, Arcadia; Peter Holbrook, Los Angeles; Bill Batterton, Torrance; Pat Fitzgerald, Northridge; Dan Roper, Redondo Beach; Min Takaki, Arleta, all of Calif.

[73] Assignee: Hughes Electronics, Los Angeles, Calif.

[21] Appl. No.: 607,037

[22] Filed: Feb. 26, 1996

[51] Int. Cl.[6] ..... H01Q 3/26

[52] U.S. Cl. ..... 342/368; 333/246; 333/260

[58] Field of Search ..... 333/238, 246, 333/260; 439/578; 342/372, 368

[56] References Cited

U.S. PATENT DOCUMENTS

| | | | |
|---|---|---|---|
| 3,943,470 | 3/1976 | Bingham | 333/260 |
| 4,070,084 | 1/1978 | Hutchison | 333/260 X |
| 4,163,955 | 8/1979 | Iden et al. | 333/238 X |
| 4,733,209 | 3/1988 | Paynting | 333/246 X |
| 4,957,456 | 9/1990 | Olson et al. | 439/578 |
| 4,995,815 | 2/1991 | Buchanan et al. | 333/260 X |
| 5,264,860 | 11/1993 | Quan | 343/767 |
| 5,357,259 | 10/1994 | Nosal | 342/372 X |
| 5,570,068 | 10/1996 | Quan | 333/260 X |

*Primary Examiner*—Paul Gensler

*Attorney, Agent, or Firm*—Leonard A. Alkov; Wanda K. Denson-Low

[57] ABSTRACT

An offset RF interconnect structure for interconnecting an active array radiating aperture to a transmit/receive (T/R) module sub-array, wherein the corresponding input/output (I/O) ports lie on different lattices. The interconnect structure employs dielectric-filled slabline transmission line, which includes a center conductor wire conductor bent to form the offset interconnection between two ports misaligned in two dimensions. The structure includes a dielectric housing that is formed by injection molding about the center slabline wire conductor. The offset interconnect structure can be integrated with an in-line coaxial interconnect structure.

7 Claims, 5 Drawing Sheets

FIG. 3.

INJECTION MOLDED OFFSET SLABLINE RF FEEDTHROUGH FOR ACTIVE ARRAY APERTURE INTERCONNECT

TECHNICAL FIELD OF THE INVENTION

This invention relates to active array antennas, and more particularly to an injection molded offset slabline RF feedthrough for interconnecting an active array radiating aperture to a transmit/receive (T/R) module sub-array whose corresponding input/output (I/O) ports lie on different lattices.

BACKGROUND OF THE INVENTION

Conventionally all components within an active antenna system must conform to the cell size dictated by the lattice spacing between the radiating elements of the antenna aperture. Future requirements for airborne radar systems continue to push this lattice spacing to ever decreasing sizes and varying shapes. This system-to-system variance in the lattice spacing impacts module design and manufacturing schedules of every program because these efforts cannot start until the aperture design is completed and the lattice spacing is established. This continuing variance of the aperture lattice spacing is a major obstacle to low cost T/R module production because of the constant need to repackage T/R module circuitry to fit within the package, preventing any standardization for long term mass production.

This invention provides a means to interconnect an active array radiating aperture to the T/R module. One conventional technique for performing this interconnection function is to use individual coaxial cables. A disadvantage of this technique is that the cables are bulky and difficult to route.

Another known approach employs stripline laminate with orthogonal launcher pins. Such laminates require many piece parts to assemble and provide lower than desired processing yield.

Yet another approach employs integrated coaxial interconnects, which requires bulky and complex shielding to provide compact coaxial interconnection.

SUMMARY OF THE INVENTION

An offset RF interconnection structure for interconnection between first and second RF ports which are offset from each other is described. The interconnection structure comprises a dielectric filled slabline transmission line, the line including a slabline wire center conductor bent to assume one or more bends and form an offset conductor having first and second conductor ends. A dielectric body surrounds a portion of the wire center conductor. The first and second wire ends interconnect with the respective first and second RF ports, and are disposed in respective first and second axes which are not collinear and which are parallel to each other.

The bends formed in the slabline center wire conductor are formed only in the H-plane of the RF energy propagated along the slabline transmission line to minimize RF mismatches across a wide frequency band. The dielectric housing is an injection molded structure, molded about the wire center conductor.

With the incorporation of this invention, both the aperture and T/R module can now be designed in parallel rather than in series. Updates in the aperture lattice during its design period will have less impact on the module design. The module package, and sub-array assembly can then be designed for optimum cost, performance and reliability without the constraints of the ever decreasing lattice dimensions. One module package design can now be applied to multiple programs thus allowing higher production runs for the larger combined quantities and eliminating redundant set up cost. This added flexibility will allow corresponding T/R modules and radiator ports to be offset in two directions laterally and two directions angularly. The final interconnection can be accomplished using this invention incorporated into the aperture plate or the sub-array assembly or into a separate interconnection assembly plate.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
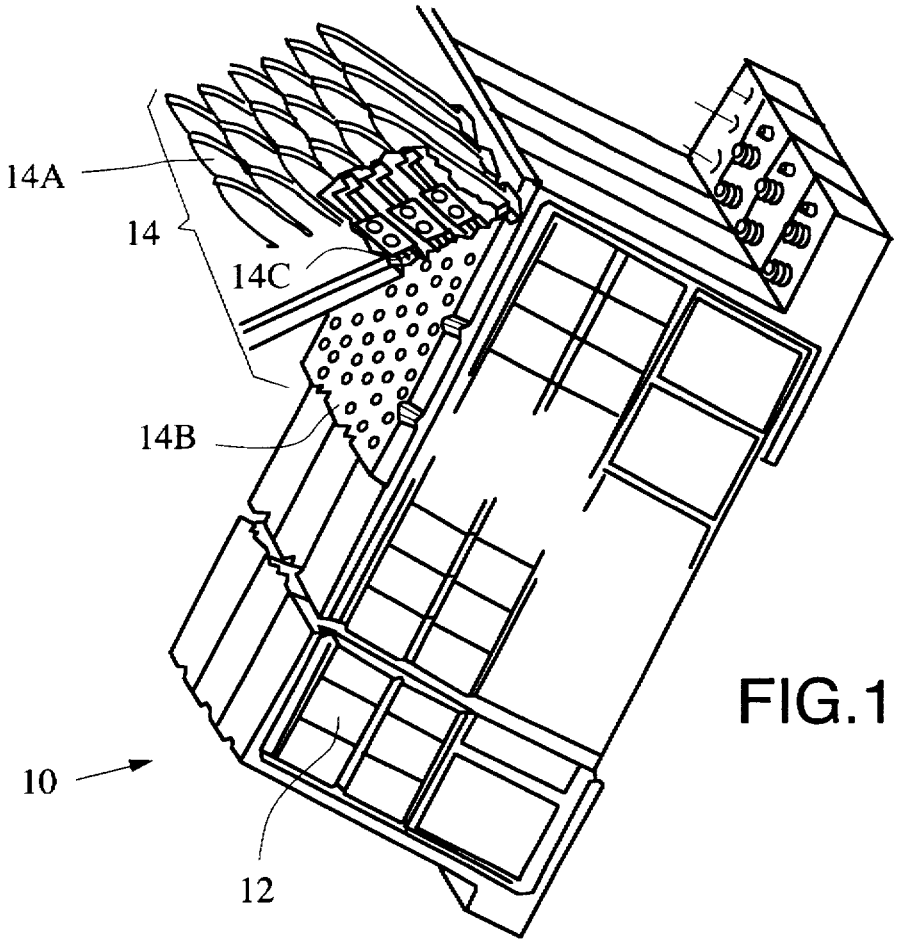
FIG. 1 is a perspective illustrative of an active array radiating aperture interconnected to the T/R module sub-array, and whose corresponding I/O ports lie on different lattices.

The invention provides a means to interconnect an active array radiating aperture to the T/R module sub-array whose corresponding I/O ports lie on different lattices, as illustrated in FIG. 1. Here, the subarray assembly 10 includes many T/R modules 12, each with corresponding transmit and receive RF ports (not shown in FIG. 1). The array further includes an aperture plate assembly 14, which comprises many radiating elements 14A, and a shear plate 14B having space provision for the individual radiator RF connectors indicated generally as 14C. The radiator connectors each mate with a corresponding T/R module connector. The T/R module (or sub-array) connectors and radiator connectors do not align; they are on different lattices or grids.

Figure 2:
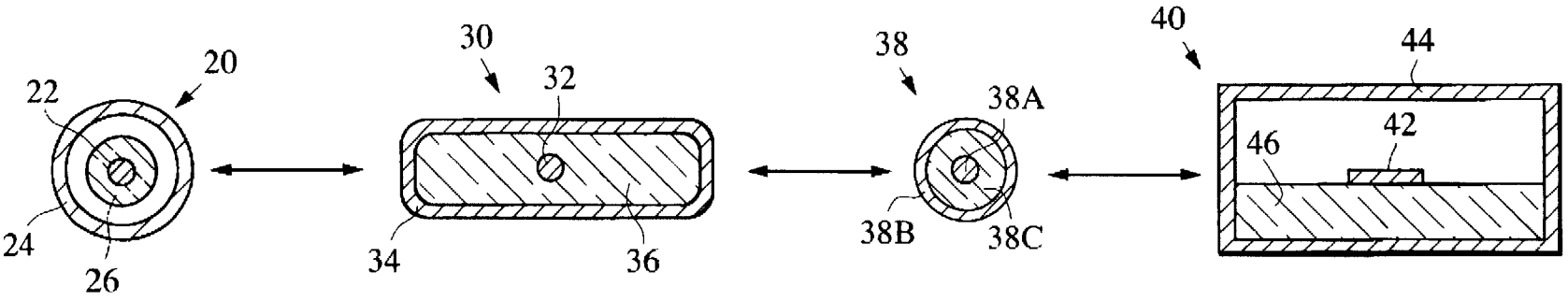
FIG. 2 is a schematic representation of an offset transition interconnect apparatus in accordance with the invention.

In one general sense, the invention is an off-set RF feedthrough that uses dielectric-filled slabline transmission line to achieve an offset interconnection transition between coaxial lines. FIG. 2 shows in a diagrammatic illustration the transition from the partially filled dielectric coaxial line 20 to the dielectric filled slab-line 30 to the dielectric filled coaxial line 38 to the shielded microstrip transmission line 40, all shown in cross-section. The coaxial line 20 includes an inner center conductor 22, an outer conductor shield 24 and the dielectric 26 partially filling the void between the center conductor and outer shield. (A partially filled dielectric coaxial line is shown by way of example; such partial filling can provide radial float clearance for easier assembly in some applications.) The slabline 30 includes a wire center conductor 32, an outer conductive shield 34, and a dielectric 36 filling the void between the conductor 32 and shield 34. While not visible in FIG. 2, the slabline wire center conductor 32 is bent to form the offset interconnection between two coaxial ports that are misaligned in two dimensions. The coaxial line 38 includes a center conductor 38A, an outer shield 38B and a dielectric filling 38C. The shielded microstrip transmission line 40 includes a center conductor strip 42, a conductive shield 44 and a dielectric sheet 46 supporting the conductor strip.

This invention provides the means to connect the T/R module ports to the corresponding radiator ports on the aperture plate even when the corresponding ports are not aligned because of different lattice spacings or different package assembly orientation. Low cost manufacturing can be achieved by using injection molded plastic for the dielectric filling in the slabline.

The offset slabline transmission line can be used to transition directly between coaxial line and shielded microstrip transmission line, i.e. omitting the intervening coaxial line 38 shown in FIG. 2.

Figure 3:
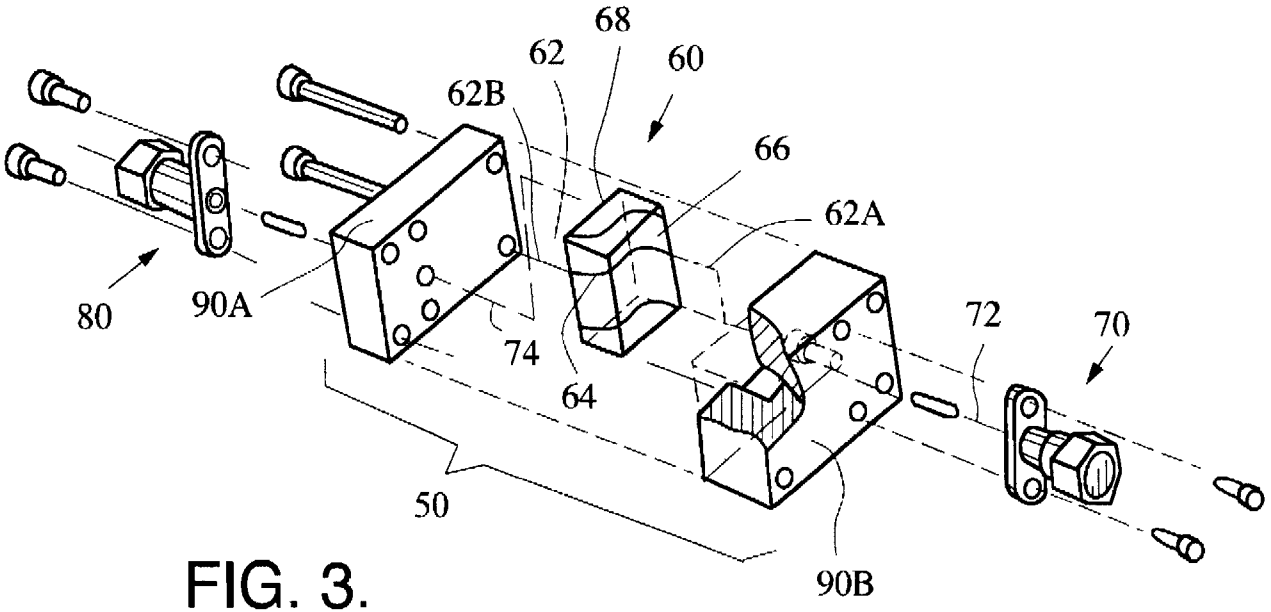
FIG. 3 is a perspective partially exploded view of a transition 50 in accordance with the invention which provides a means to interconnect an active array radiating aperture to the T/R module sub-array, and whose corresponding I/O ports lie on different lattices.

FIG. 3 is a perspective partially exploded view of a transition 50 in accordance with the invention which provides a means to interconnect an active array radiating aperture to a T/R module sub-array, and whose corresponding I/O ports lie on different lattices. The transition 50 is an off-set RF feedthrough that employs a section 60 of dielectric-filled slabline transmission line. A slabline wire center conductor 62 is bent to form the offset interconnection (an "S" shape for example) between the two coaxial ports 70 and 80 that are misaligned in two dimensions. The wire conductor 62 in this embodiment has a circular cross-section, and an exemplary 20 mil diameter for operation at X-band. The transition further includes a dielectric member 68 formed around the center conductor 62. The dielectric can be injection molded around the formed center conductor, or fabricated in two or more sections, which are assembled around the center conductor 62. Metal housings 90A and 90B form the outer shield for the slabline section 60.

The wire 62 is connected to the coaxial center conductors at each port using spring fingers within the coaxial center conductor to capture the wire ends.

In the slabline geometry shown in FIG. 3, the RF transmission properties are dominated by the center-conductor diameter and by the height between the top and bottom walls, i.e. the narrow dimension of the dielectric member. The peak electric field is polarized along a line between the top and bottom walls. The "E-plane" is parallel to this line and perpendicular to the page. The offset transition 50 uses only "H-plane" bends in the center conductor 62, including bends 64 and 66, thus minimizing RF mismatches across a wide frequency band. There are no changes to the electric field polarization as the RF signal travels along the slabline transmission line 60, because the center conductor diameter and dielectric height are held constant. This minimization in changes in the electric field polarization is important, to minimize shunt capacitance at E-field bends. The slabline conductor 62 can be bent in the H-plane at angles from 0 degrees to 90 degrees thus providing added angular freedom. This offset slabline transition will allow for interconnection between corresponding ports displaced laterally in two directions and angularly in two directions.

Figure 4A:
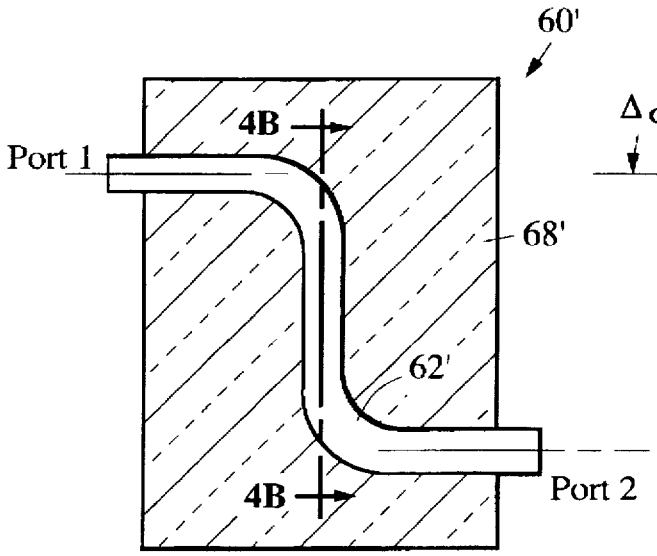
FIGS. 4A and 4B are respective side and end cross-sectional views of an offset slabline transition structure to illustrate two dimensional displacement between the transition ports.
Figure 4B:
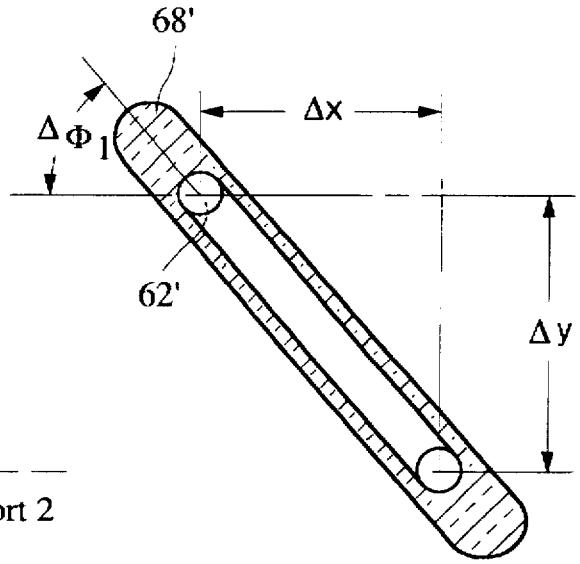

FIGS. 4A–4B and 5A–5B show two exemplary embodiments of the offset slabline transmission line. FIGS. 4A and 4B are respective side and end cross-sectional views of a first exemplary embodiment 60', comprising the center wire conductor 62' which is embedded in a dielectric insulator 68'. In this embodiment, the transmission line 60' is inclined from the horizontal by angle $\Delta\phi_1$ as shown in FIG. 4B, with ports 1 and 2 offset in X and Y by distances $\Delta x$ and $\Delta y$. In this embodiment, the respective ends of the wire conductor at ports 1 and 2 are in a parallel, offset arrangement.

Figure 5A:
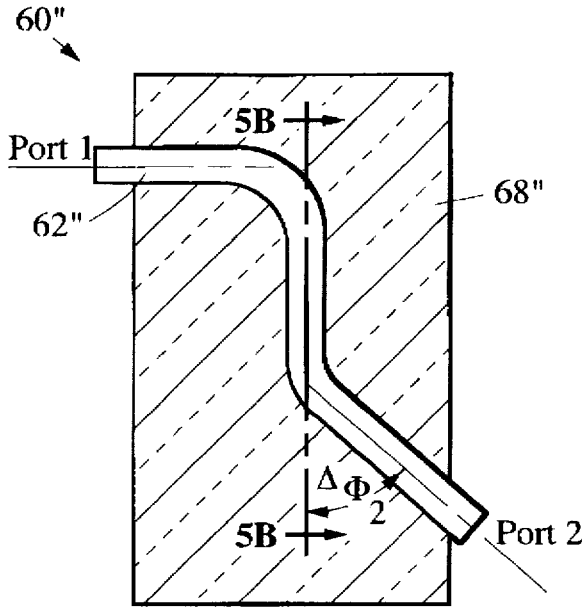
FIGS. 5A and 5B are respective side and end cross-sectional views of an offset slabline transition structure to illustrate two dimensional and angular displacement between the transition ports.
Figure 5B:
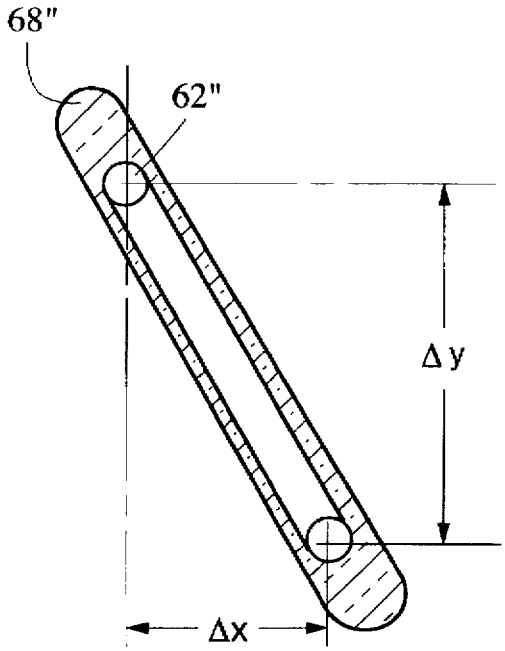

FIGS. 5A and 5B show a similar offset slabline transmission line 60", except that the respective ends of the wire conductor 62" embedded in the dielectric insulator 68" at ports 1 and 2 are not in parallel. While the wire end at port 1 is at an angle of 90 degrees from the vertical, the wire end at port 2 is at an angle of $\Delta\phi_2$ from the vertical.

Thus, this invention provides a means to connect the T/R module ports to the corresponding radiator ports on the aperture plate even when the corresponding ports are not aligned because of different lattice spacings or different package assembly orientation. In the exemplary embodiment of FIG. 3, one end 62A of the wire conductor 62 will lie along axis 72, and the other end 62B will lie along axis 74 when the structure is assembled. The axes 72 and 74 are parallel but not collinear, similar to transmission line 60' of FIGS. 4A and 4B. Of course, in other exemplary embodiments, the ends of the wire center conductor of the slabline transmission line will not be in a parallel arrangement, as shown in FIGS. 5A and 5B.

Figure 6:
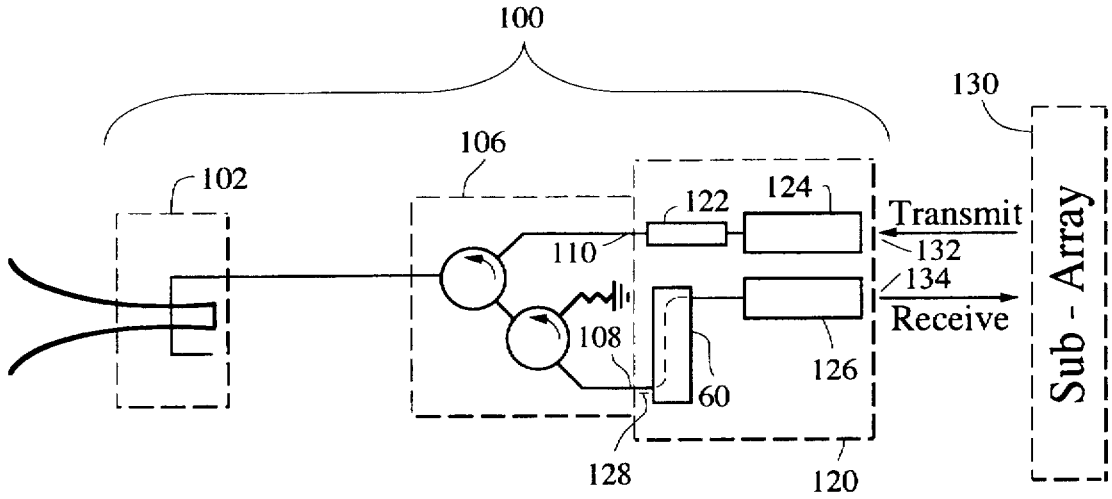
FIG. 6 is an active array circuit schematic, showing an exemplary implementation of the slabline offset transition within a flared notch radiator assembly of an active array system.

FIG. 6 shows an active array circuit schematic, showing an exemplary implementation of the slabline offset transition 60 within a flared notch radiator assembly 100 of an active array system. The assembly 100 includes a flared notch radiator transition 102 connected to an integrated microstrip 3-port circulator circuit 106. The circuit 106 is in turn connected by means of radiator interconnection circuit 120 to the T/R module sub-array 130. The interconnection circuit 120 includes an in-line coaxial transition 122 which transitions from microstrip transmission line 110 at one port of the circulator 106 to a self-aligning RF push-on coaxial connector 124 of the type described in commonly assigned U.S. Pat. No. 4,957,456, the entire contents of which are incorporated herein by this reference. The interconnection circuit 120 further includes an offset transition 60 in accordance with the invention. At one end of the offset transition 60, an RF transition is provided from slabline to in-line coaxial line section 128 to a microstrip transmission line 108 connecting the circulator 106 within the radiator assembly. At the other end of the offset transition 60, the slabline transitions to partially filled coaxial transmission line with tapered outer shielding to provide a radial self-alignment feature for connection to connector 126 and the sub-array receive port 134.

Figure 7:
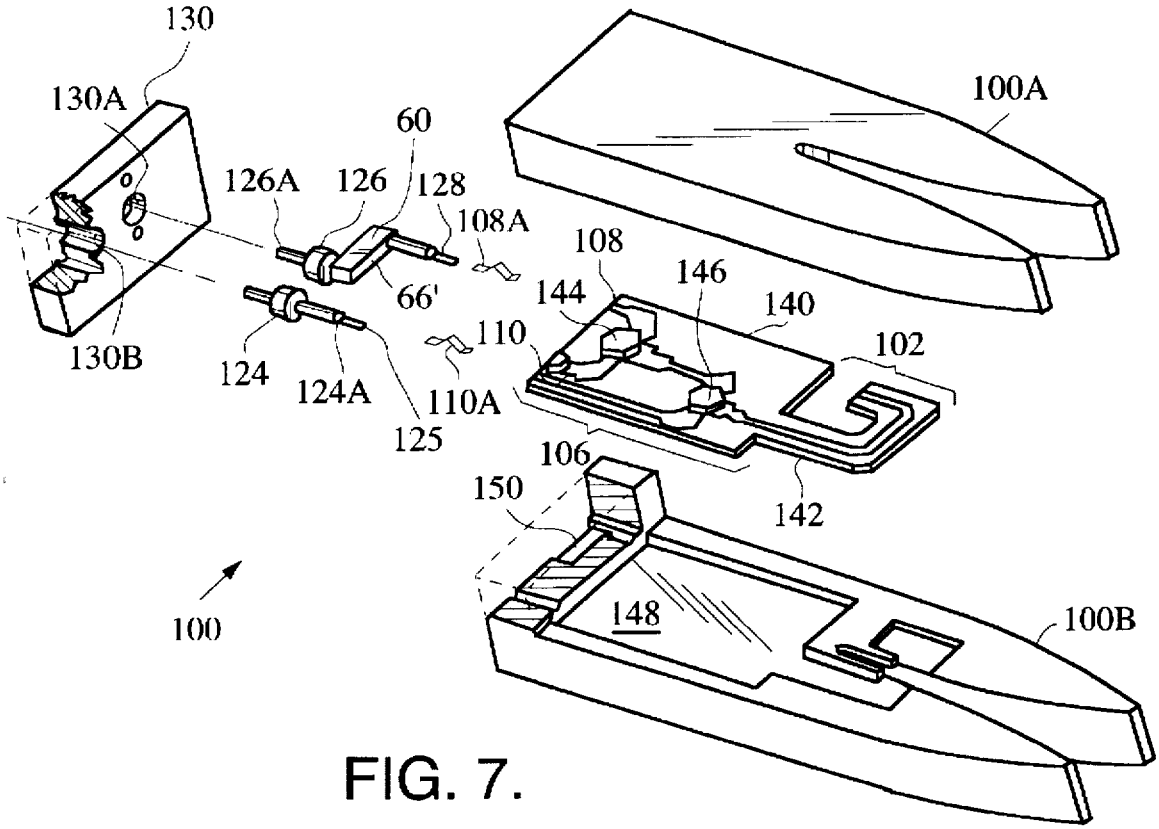
FIG. 7 shows in exploded perspective view an exemplary implementation of the offset transition into the radiator assembly of FIG. 6.

FIG. 7 shows in exploded perspective view an exemplary implementation of assembly 100 of FIG. 6. The assembly 100 includes upper and lower radiator housings 100A and 100B. These housings sandwich a dielectric substrate board 140 which has defined thereon a conductor pattern 142, in the same manner as described in commonly assigned U.S. Pat. No. 5,264,860, the entire contents of which are incorporated herein by this reference. The board and conductor pattern comprise a balun in the radiator transition 102. The microstrip circulator 106 is defined by the conductor pattern and the two circulators 144 and 146. The board 140 and circulators 144 and 146 fit into recessed areas (indicated generally as 148) formed in the housing elements, so that the conductor pattern does not come into electrical contact with the metal surfaces of the housings. The metal surfaces provide the interconnect ground return and outer conductor shielding. Not shown are such conventional structure as a steel plate residing below the circulators to complete the magnetic circuit.

Figure 8:
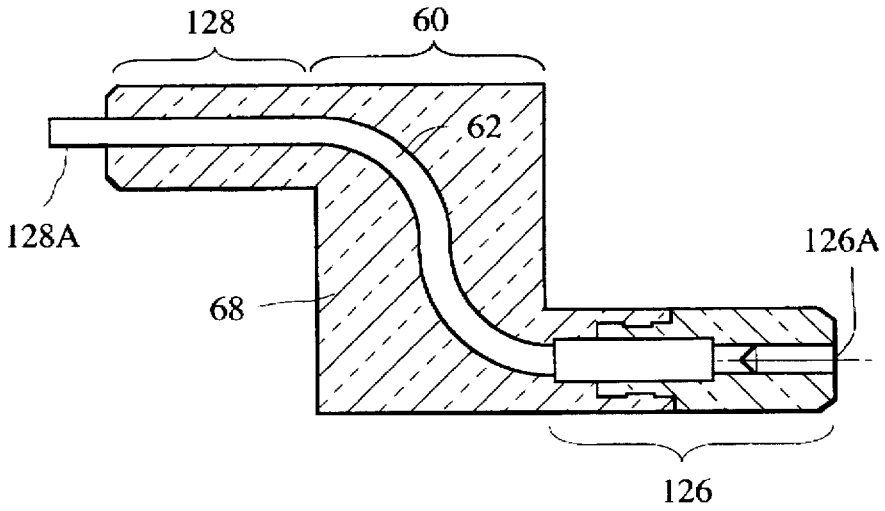
FIG. 8 is a side cross-sectional view of an offset slabline transition structure integrated with in-line coaxial line sections.

The assembly 100 further includes the in-line coaxial connectors 124, 126 and 128, and the off-set transition 60. The connectors 126, 128 and transition 60 can be fabricated as an integrated structure, as shown in FIG. 8. A channel recess is formed in the upper and lower housings 100A and 100B to receive the dielectric body 66' of the transition 60; only recess 150 is visible in FIG. 7. Another recess is formed in the housings 100A and 100B for receiving the dielectric body 124A of the connector 124.

FIG. 8 shows the offset slabline transition 60 integrated with the coaxial connector 126 and 128. Here the center wire conductor 62 extends into the coaxial connectors 126 and 128 to form the center conductors in the coaxial sections. End 128A is for connection to the microstripline within the circulator 106. End 126A is formed with spring fingers to accept the corresponding coaxial center conductor of the T/R module connector.

After assembly, the end 128A of the conductor 62 is connected by a ribbon wire coaxial-to-microstripline transition 108A (FIG. 7) to the microstrip transition conductor 108 defined on the dielectric board 140, and the end of the coaxial conductor 125 is connected by a ribbon wire transition 110A to the microstrip transition conductor 110 defined on the dielectric board 140.

The baseplate 130 includes corresponding bores 130A and 130B which receive portions of the dielectric bodies of the connectors 126 and 124, respectively, when the plate is assembled to the radiator assembly 100.

The integrated coaxial section of this invention, i.e. the offset slabline interconnect and the circular coaxial connectors at each end, will compensate for any polarization angular offsets between the radiators in the aperture and T/R modules within the sub-array. The compensation enables the invention to accommodate two dimension lateral displacement.

Low cost manufacturing is achieved by using injection molded plastic for the dielectric filling of the offset transition. By using injection molded plastic to form the interconnect dielectric around a pre-bent wire, the in-line coaxial connector 126, the offset slabline transition 60 and microstrip transition sections can then be integrated as a one-piece connector insertable into the antenna array. The RF connection path is completed by using the chassis of the radiator and sub-array for the shielded ground return. The invention uses a minimum number of basic material for one piece construction.

Figure 9:
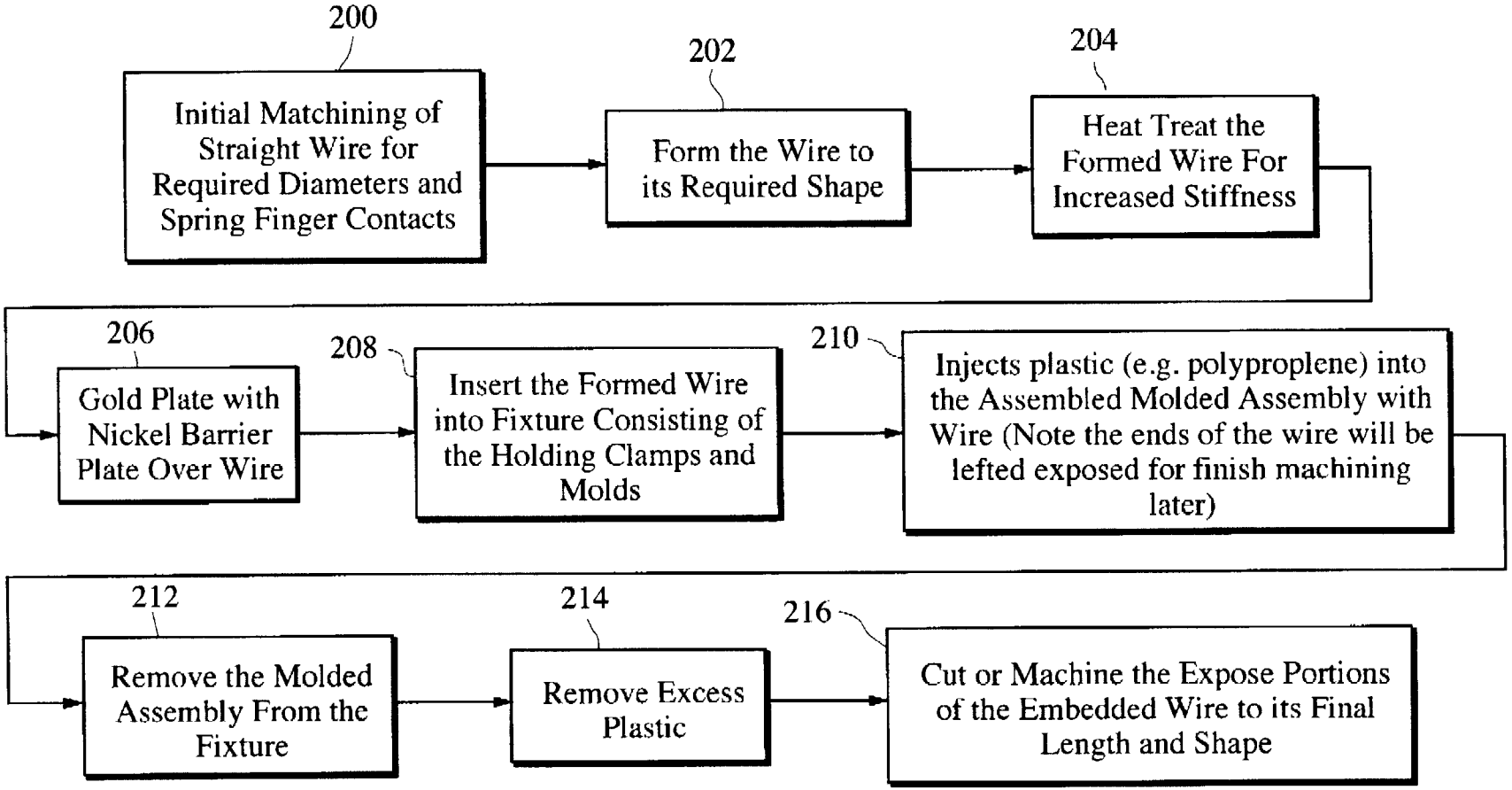
FIG. 9 is a flow diagram illustrating an exemplary fabrication process for fabricating a transition structure embodying the invention.

FIG. 9 is a flow diagram illustrating the injection molding fabrication process. At step 200, a straight section of the wire is machined to the required diameter and to form the spring finger contacts. At step 202, the straight section of wire is formed to its required shape. At step 204, the formed wire is heat treated to provide increase stiffness. At step 206, the wire is nickel and gold plated. The formed, plated wire is then inserted into a fixture which includes holding clamps and molds (step 208). Molten plastic (e.g. polypropylene) is then injected into the assembled molded assembly with the wire, with the ends of the wire left exposed for later finish machining (step 210). After cooling, the molded assembly is removed from the fixture (step 212), excess plastic is removed (step 214) and the exposed portions of the embedded wire are cut or machined to the final length and shape (step 216).

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An active radar array, comprising:

a plurality of radiating elements, each element having at least one radiator port associated therewith;

a plurality of transmit/receive (T/R) modules, each module associated with a corresponding radiating element, each T/R module having at least one T/R port associated therewith, wherein the T/R port is a coaxial transmission line;

wherein the radiator port and the T/R port lie on different lattices and are offset from each other in at least two dimensions, and wherein the radiator port is a microstrip transmission line; and an offset RF interconnection structure for RF interconnection between said radiator port and said T/R port, the interconnection structure comprising a dielectric filled slabline transmission line, the line including a slabline wire center conductor bent to assume one or more bends and form an offset conductor, the conductor having first and second conductor ends, a dielectric body surrounding a portion of the wire center conductor, the first and second wire ends to interconnect with the respective radiator and T/R ports, wherein the first and second wire ends are disposed in respective first and second axes which are not collinear, and an outer slabline conductive housing within which said dielectric body is disposed, said housing comprising first and second generally parallel opposed planar conductive wall surfaces, and the offset RF interconnection structure further includes an in-line section of coaxial line connected to one end of the slabline transmission line and a transition structure between said in-line section and said microstrip transmission line.

2. The array of claim 1 wherein the bends formed in the slabline center wire conductor are formed only in the H-plane of the RF energy propagated along the slabline transmission line to minimize RF mismatches across a wide frequency band, said H-plane extending parallel to said first and second wall surfaces.

3. The array of claim 1 wherein the dielectric body is an injection molded structure, molded about the wire center conductor.

4. The array of claim 1 wherein said first and second axes are parallel.

5. The array of claim 1 wherein said first and second axes are not parallel.

6. The array of claim 1 further including an electrically conductive housing structure, the dielectric body being disposed within the housing structure.

7. An active radar array, comprising:

a plurality of radiating elements, each element having at least one radiator port associated therewith, wherein said radiator port is a microstrip transmission line;

a plurality of transmit/receive (T/R) modules, each module associated with a corresponding radiating element, each T/R module having at least one T/R port associated therewith, wherein said T/R port is a coaxial line;

wherein the radiator port and the T/R port lie on different lattices and are offset from each other in at least two dimensions; and an offset RF interconnection structure for RF interconnection between said radiator port and said T/R port, the interconnection structure comprising a dielectric filled slabline transmission line, the line including a slabline wire center conductor bent to assume one or more bends and form an offset conductor, the conductor having first and second conductor ends, a dielectric body surrounding a portion of the wire center conductor, the first and second wire ends to interconnect with the respective radiator and T/R ports, wherein the first and second wire ends are disposed in respective first and second axes which are not collinear, and an outer slabline conductive housing within which said dielectric body is disposed, the interconnection structure further including an in-line section of coaxial line connected to one end of the slabline transmission line and a transition structure between said in-line section and said microstrip transmission line, and wherein the transition structure is a ribbon wire transition structure.

* * * * *